US010119498B2

(12) United States Patent
Meano et al.

(10) Patent No.: US 10,119,498 B2
(45) Date of Patent: Nov. 6, 2018

(54) ENHANCED LONG ROUTE EGR COOLER ARRANGEMENT WITH BYPASS

(71) Applicant: GM Global Technology Operations LLC, Detroit, MI (US)

(72) Inventors: Cesare Maria Meano, Turin (IT); Riccardo Baria, Bruino (IT); Andrea Tripodi, Genoa (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1 day.

(21) Appl. No.: 15/421,796

(22) Filed: Feb. 1, 2017

(65) Prior Publication Data

US 2018/0216580 A1 Aug. 2, 2018

(51) Int. Cl.
*F02M 26/00* (2016.01)
*F02M 26/25* (2016.01)
*F02M 26/14* (2016.01)

(52) U.S. Cl.
CPC ..... *F02M 26/25* (2016.02); *F02M 26/14* (2016.02)

(58) Field of Classification Search
CPC ..... F02M 26/14; F02M 26/25; F02M 26/04; F02M 26/05; F02M 26/06; F02M 26/13; F02M 26/19; F02M 26/22; F02M 26/23; F02M 26/24; F02M 26/28; F02M 26/32; F02M 26/33; F02M 26/43; F02M 26/47; F02M 35/10222
See application file for complete search history.

(56) References Cited

U.S. PATENT DOCUMENTS 5,690,082 A * 11/1997 Tanioka ..... F01P 3/20 123/41.28
6,976,480 B2 * 12/2005 Miyoshi ..... F02M 26/57 123/568.12
7,363,919 B1 * 4/2008 Styles ..... F01N 5/02 123/568.12
9,103,268 B2 * 8/2015 Mueller ..... F02B 29/0418
2007/0017489 A1 * 1/2007 Kuroki ..... F02M 26/25 123/568.12
2007/0289581 A1 * 12/2007 Nakamura ..... F28D 9/0025 123/568.12
2008/0314569 A1 * 12/2008 Yamazaki ..... F02M 37/0029 165/153

(Continued)

*Primary Examiner* — Hieu T Vo
*Assistant Examiner* — Sherman Manley
(74) *Attorney, Agent, or Firm* — Harness, Dickey & Pierce, P.L.C.

(57) ABSTRACT

An internal combustion engine includes an air intake system in communication with a plurality of cylinders. An exhaust system is in communication with the plurality of cylinders. An EGR passage is in communication with the exhaust system and the air intake system. The EGR passage includes an EGR cooler with an EGR inlet end with a passage having a first portion extending in one direction in an assembled condition toward an intermediate section. The passage includes a second portion extending in an opposite direction from the intermediate section toward an EGR outlet end. A first cooler matrix is disposed in the first portion and a second, optional, cooler matrix disposed in the second portion. A thermally separated bypass channel is provided to allow a fast warm-up and guarantee the lowest possible pressure drop. The EGR cooler shape allows a compact packaging around the bypass pipe.

6 Claims, 5 Drawing Sheets

(56) References Cited

U.S. PATENT DOCUMENTS

| | | | | |
|---|---|---|---|---|
| 2009/0084920 | A1* | 4/2009 | Cerabone | B60K 5/12 248/309.1 |
| 2010/0154753 | A1* | 6/2010 | Shimoyama | F02B 77/11 123/509 |
| 2011/0315129 | A1* | 12/2011 | Kojima | F02F 1/243 123/568.12 |
| 2014/0318511 | A1* | 10/2014 | Sekiya | F01N 13/08 123/568.11 |
| 2015/0059715 | A1* | 3/2015 | Forshier | F02M 26/12 123/568.12 |
| 2016/0160805 | A1* | 6/2016 | Polcyn | F02M 26/70 123/568.18 |

* cited by examiner

ENHANCED LONG ROUTE EGR COOLER ARRANGEMENT WITH BYPASS

FIELD

The present disclosure relates to a long route exhaust gas recirculation cooler arrangement with bypass.

BACKGROUND

This section provides background information related to the present disclosure which is not necessarily prior art.

If the coolant temperature in the cooler of a long route EGR system falls below the dew point, condensation can happen, which can affect the compressor wheel.

SUMMARY

This section provides a general summary of the disclosure, and is not a comprehensive disclosure of its full scope or all of its features.

The present disclosure provides an improved long route EGR cooler arrangement to allow operation at lower coolant temperatures. The present disclosure further provides a direct path bypass pipe to allow a fast warm-up and guarantee the lowest possible pressure drop. The EGR cooler is V-shaped and may include one or two cooler matrices for compact packaging around the bypass pipe. An intermediate section of the V-shaped cooler is designed to collect condensates and is in contact with an end section of the aftertreatment system to promote evaporation and warm-up of the cooler. A flow blending valve is provided to modulate the EGR flow and blend the bypassed and cooled exhaust flow portions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
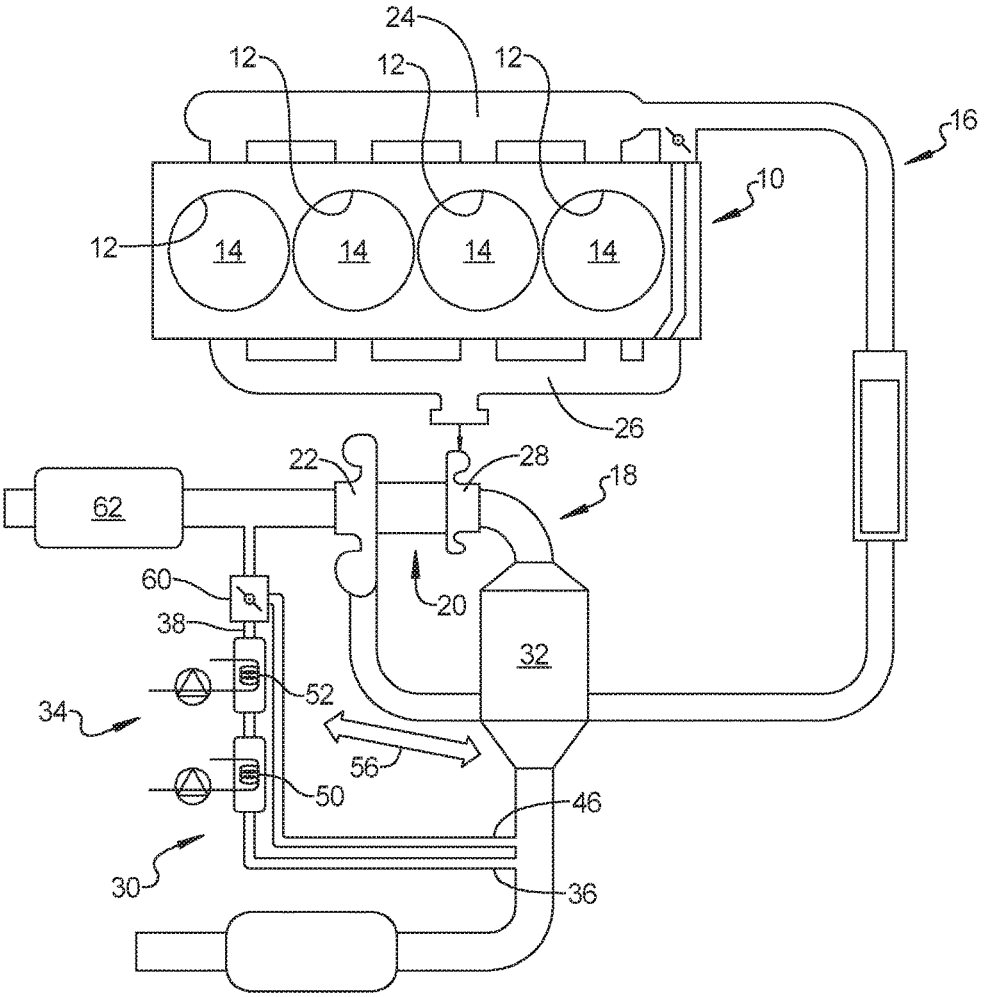
FIG. 1 is a schematic view of an internal combustion engine having a long route EGR system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not to be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, an internal combustion engine 10 is shown including a plurality of cylinders 12 each having a working piston 14 disposed therein. The internal combustion engine 10 has an intake system 16 and an exhaust system 18. The intake system 16 can be provided with a turbocharger 20 having a compressor wheel 22 for providing compressed intake air to an intake manifold 24 which is connected to the cylinders 12. The exhaust system 18 includes an exhaust manifold 26 which directs exhaust gasses to a turbine wheel 28 of the turbocharger 20 (if present).

Figure 3:
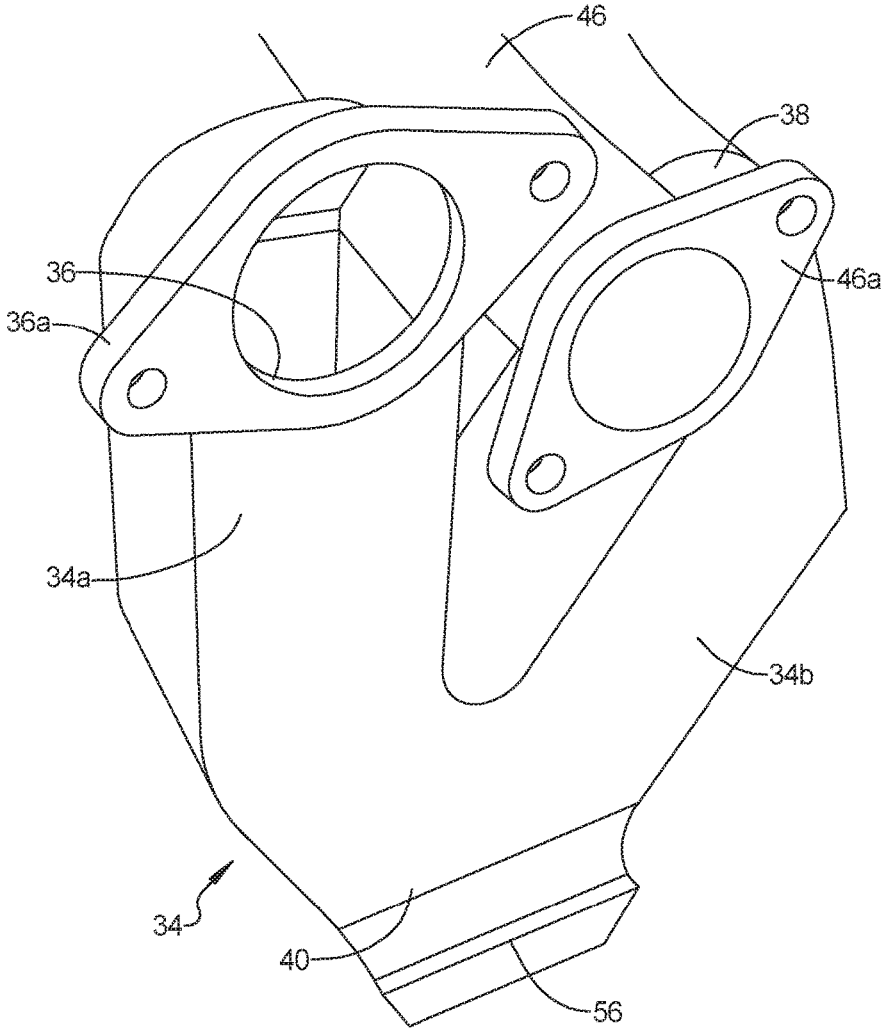
FIG. 3 is a schematic perspective view of the EGR cooler and bypass pipe according to the principles of the present disclosure.

An exhaust gas recirculation (EGR) system 30 is connected between an aftertreatment system 32 of the exhaust system 18 and the intake system 16. The EGR system 30 includes an EGR cooler 34 that has a V-shape, as best shown in FIG. 3, and including an EGR inlet end 36 and an EGR outlet end 38. In an assembled condition, as shown in FIG. 3, the EGR cooler 34 includes a vertically descending portion 34*a* extending from the EGR inlet end 36 toward an intermediate section 40. A vertically ascending portion 34*b* extends from the intermediate section 40 to the EGR outlet end 38 of the V-shaped EGR cooler 34. The intermediate section 40 is disposed in heat conducting contact with an end section 42 of the aftertreatment system 32. It should be understood that although a V-shaped EGR cooler 34 is shown, others shapes such as a U-shape or a J-shape can be utilized along with a vertically descending portion, a vertically ascending portion and an intermediate section in which condensates can collect. The vertically descending and ascending portions can both include a cooler matrix each, or only one of the two portions can be provided with a cooler matrix. The two portions may either have similar extension, or one may be smaller than the other. As also mentioned in, alternative layouts can be considered provided that the direction of the portion cooled by first matrix is opposite to the direction of the portion following the intermediate section, in which condensates can be collected.

Figure 5:
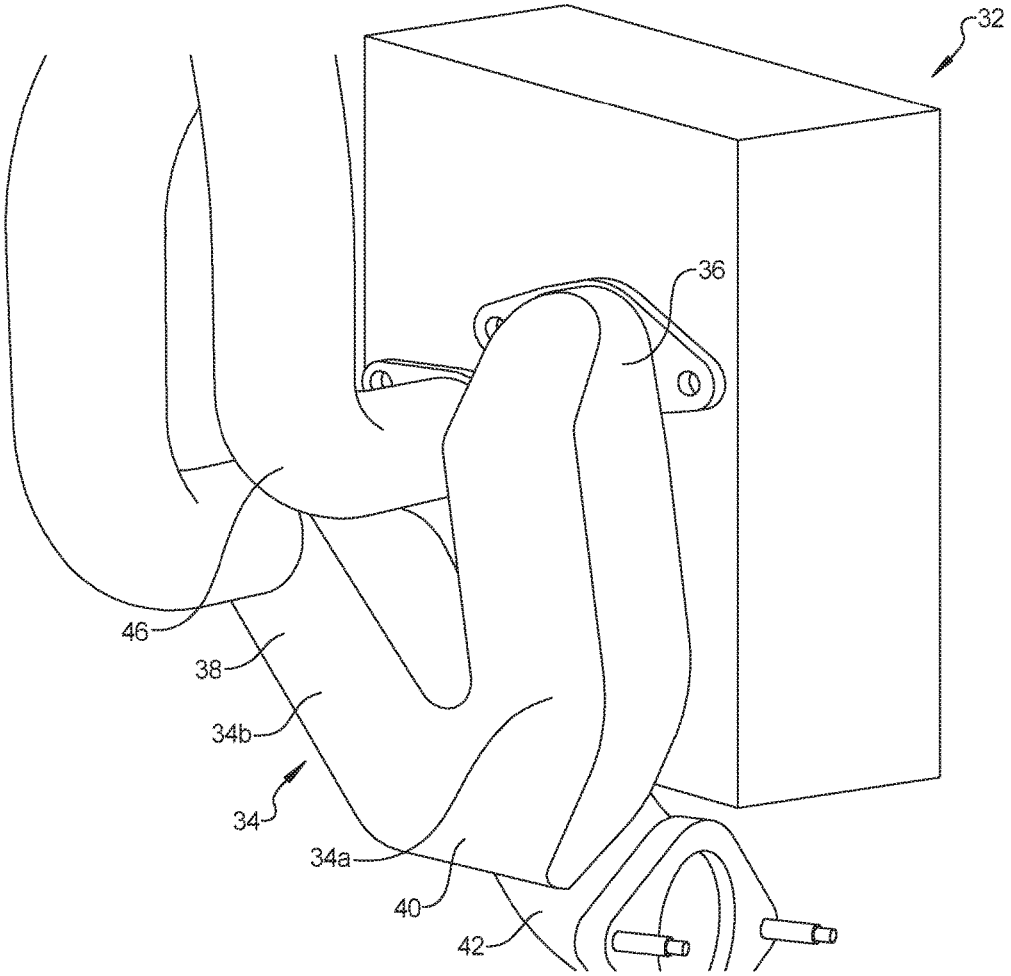
FIG. 5 is a perspective view of the EGR cooler and bypass pipe connected to an aftertreatment system housing according to the principles of the present disclosure.

With continued reference to FIG. 3, a bypass pipe 46 is connected to the aftertreatment system 32 at a location between the EGR inlet end 36 and the EGR outlet end 38 of the V-shaped EGR cooler 34. The EGR inlet end 36 of the V-shaped EGR cooler 34 and the bypass pipe 46 can each be provided with a mounting flange portion 36*a*, 46*a*, respectively, for connecting the EGR cooler 34 and the bypass pipe 46 to the aftertreatment system 32 or another component of the exhaust system 18, as best shown in FIG. 5.

Figure 4:
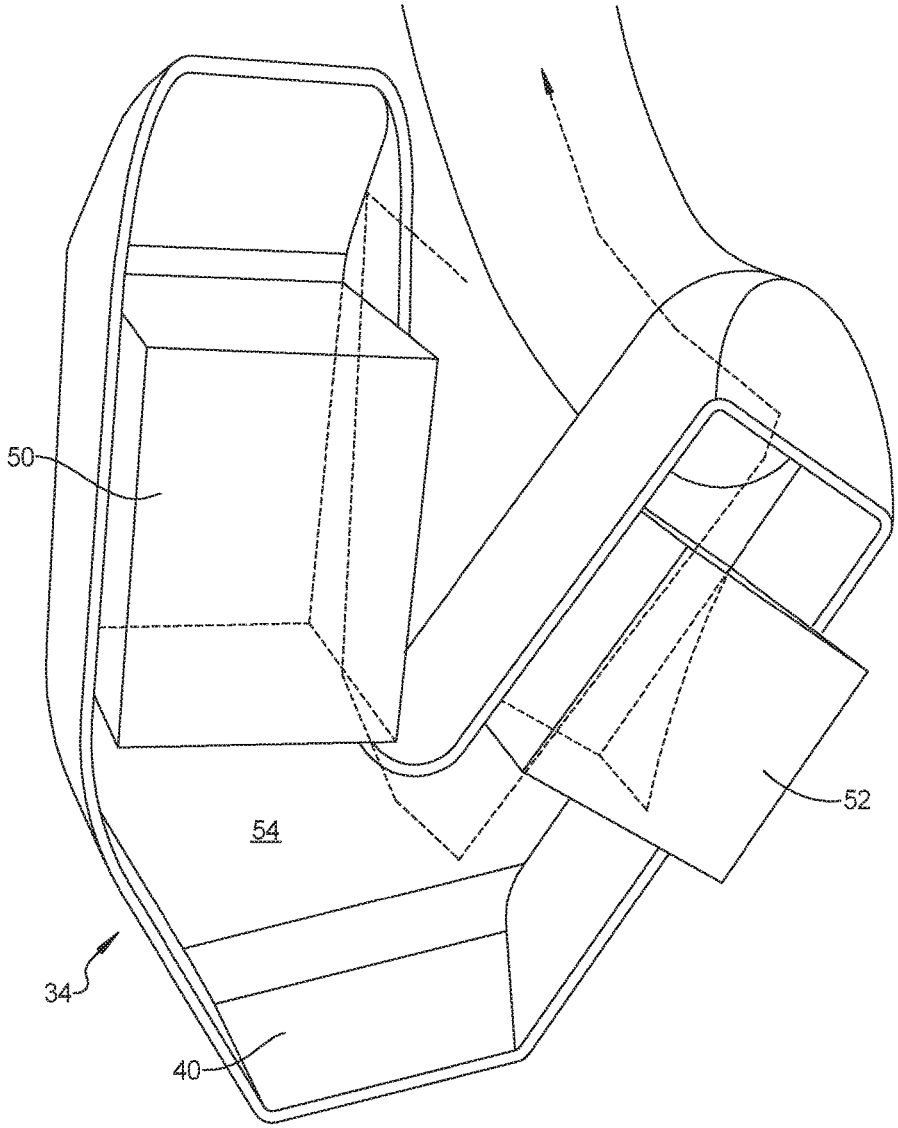
FIG. 4 is a schematic, partial cutaway view of the EGR cooler showing the interior cooler matrices according to the principles of the present disclosure.

As best shown in FIG. 4, a partial cutaway view of the EGR cooler 34 is shown including a first cooler matrix 50 and a second optional cooler matrix 52 within a V-shaped passageway 54 through which the exhaust gases are directed. The first and second cooler matrices 50, 52 are preferably liquid cooled. They may be either connected to the same cooling circuit or to different cooling circuits (for example, working at different temperatures). When connected to the same circuit, this may be done in different ways, e.g. in series, in parallel and any combination of those. Any condensation that forms within the EGR cooler 34 can collect in the intermediate section 40. The aftertreatment system 32 that contacts the intermediate section 40 is a heat source 56 for re-evaporating the condensed liquid within the intermediate section 40. The heat source 56 is schematically illustrated in FIG. 1 and is shown as a protruding portion 56 in FIG. 3 that can extend into direct heat transfer contact with the aftertreatment system 32.

Figure 2:
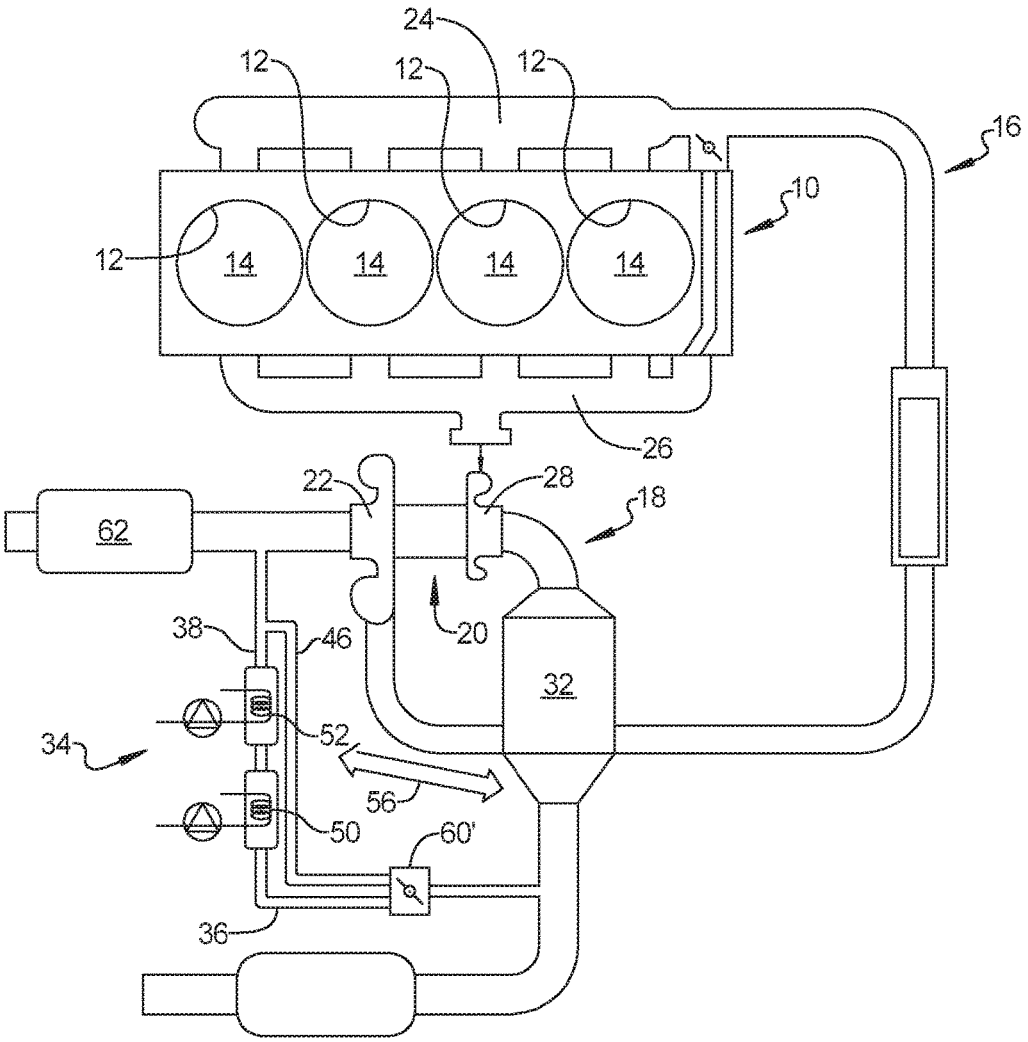
FIG. 2 is a schematic view of an internal combustion engine having an alternative long route EGR system according to the principles of the present disclosure.

With reference to FIG. 1, a flow blending valve 60 is in communication with the EGR cooler 34 and the bypass pipe 46 at a downstream location to modulate the EGR flow and blend the bypassed and cooled exhaust portions for reintroduction into the air intake system 16 at a location downstream from an air flow meter 62 and upstream of the compressor 22 of the turbocharger 20. According to an alternative embodiment as shown in FIG. 2, wherein like reference numerals designate the same or similar parts, the blend valve 60' can be provided up stream of the EGR cooler 34 and the bypass pipe 46.

The system of the present disclosure provides an innovative layout with a dual matrix EGR cooler 34 for compact packaging around the bypass pipe 46 and flexible coolant feeding. The vertically lower intermediate section 40 is designed to collect condensates and is in metal contact with the aftertreatment system 32 to promote evaporation of condensates and cooler warm-up. The flow blending valve 60 is provided to modulate the EGR flow and blend the bypassed and cooled exhaust gas portions. The system provides for the possible usage of the bypass at low loads when the long route EGR system may be limited by throttling wherein the bypass pipe 46 is designed as a lower-pressure-drop path compared to the cooled path. The bypass pipe 46 is also used to operate the EGR cooler at low temperatures.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An internal combustion engine, comprising:

an engine structure including a plurality of cylinders;

an air intake system in communication with the plurality of cylinders;

an exhaust system in communication with the plurality of cylinders;

an EGR passage in communication with the exhaust system and the air intake system, said EGR passage including an EGR cooler with an EGR inlet end with a passage having a vertically descending portion extending downward in an assembled condition in an exhaust system to an intermediate section downstream from the vertically descending portion;

the passage including a vertically ascending portion downstream from the intermediate section and extending upward from the intermediate section toward an EGR outlet end; and a first cooler matrix disposed in the vertically descending or vertically ascending portions, wherein the intermediate section is in direct contact with the exhaust system.

2. The internal combustion engine according to claim 1, wherein a second cooler matrix is disposed in the other of the vertically descending and vertically ascending portions.

3. An internal combustion engine, comprising:

an engine structure including a plurality of cylinders;

an air intake system in communication with the plurality of cylinders;

an exhaust system in communication with the plurality of cylinders;

an EGR passage in communication with the exhaust system and the air intake system, said EGR passage including an EGR cooler with an EGR inlet end with a passage having a vertically descending portion extending downward in an assembled condition in an exhaust system to an intermediate section downstream from the vertically descending portion;

the passage including a vertically ascending portion downstream from the intermediate section and extending upward from the intermediate section toward an EGR outlet end; and a first cooler matrix disposed in the vertically descending or vertically ascending portions, wherein the intermediate section is in direct contact with an aftertreatment system of the exhaust system.

4. The internal combustion engine according to claim 3, wherein the passage has a V-shape.

5. An internal combustion engine, comprising:

an engine structure including a plurality of cylinders;

an air intake system in communication with the plurality of cylinders;

an exhaust system in communication with the plurality of cylinders;

an EGR passage in communication with the exhaust system and the air intake system, said EGR passage including an EGR cooler with an EGR inlet end with a passage having a vertically descending portion extending downward in an assembled condition in an exhaust system to an intermediate section downstream from the vertically descending portion;

the passage including a vertically ascending portion downstream from the intermediate section and extending upward from the intermediate section toward an EGR outlet end; and a first cooler matrix disposed in the vertically descending or vertically ascending portions, further comprising a bypass pipe connected to the EGR passage to bypass the EGR cooler.

6. The internal combustion engine according to claim 5, wherein the bypass pipe is disposed between the EGR inlet end and the EGR outlet end of the EGR cooler.

* * * * *